8/2/83 OR 4,396,071

United States Patent [19]

Stephens

[11] 4,396,071

[45] Aug. 2, 1983

[54] MUD BY-PASS REGULATOR APPARATUS FOR MEASUREMENT WHILE DRILLING SYSTEM

[75] Inventor: Kelly D. Stephens, Houston, Tex.

[73] Assignee: Dresser Industries, Inc., Dallas, Tex.

[21] Appl. No.: 280,433

[22] Filed: Jul. 6, 1981

[51] Int. Cl.[3] ..... E21B 47/00; E21B 34/10

[52] U.S. Cl. ..... 175/50

[58] Field of Search ..... 175/50, 48, 45, 243, 175/317, 26, 93; 166/66, 113, 250, 320; 340/856, 861; 137/494

[56] References Cited

U.S. PATENT DOCUMENTS

| | | | |
|---|---|---|---|
| 2,787,759 | 4/1957 | Arps | 175/50 |
| 3,194,325 | 7/1965 | Gianelloni, Jr. | 175/26 |
| 3,802,515 | 4/1974 | Flamand et al. | 175/26 X |
| 4,184,545 | 1/1980 | Claycomb | 166/113 |

*Primary Examiner*—Ernest R. Purser

*Assistant Examiner*—Thuy M. Bui

*Attorney, Agent, or Firm*—Richard M. Byron

[57] ABSTRACT

A mud by-pass regulator apparatus is provided to regulate the flow of drilling fluid or mud through the downhole portion of a power supply in a measurement while drilling system. The mud by-pass regulator apparatus includes a valve, valve actuator, and a valve actuator control operable to regulate the flow of drilling fluid through the power supply within predetermined limits. The apparatus automatically causes the drilling fluid to by-pass the power supply under certain conditions to maintain regulation of the drilling fluid through the power supply so that its operation is maintained within required limits of the downhole portion of the measurement while drilling apparatus. Motion of the valve is accomplished by the valve actuator and the valve actuator control which is responsive to the pressure drop across a motive power source in the downhole power supply.

18 Claims, 5 Drawing Figures

MUD BY-PASS REGULATOR APPARATUS FOR MEASUREMENT WHILE DRILLING SYSTEM

TECHNICAL FIELD

This invention is related to measurement while drilling systems associated with the formation of earth boreholes. More particularly this invention is related to such systems that have a downhole power supply for extracting energy from drilling fluid passing through the drill string and converting it to energy usable in the other down-apparatus of this system. Specifically, this invention is a mud or drilling fluid by-pass regulator apparatus for regulating the flow of drilling fluid passing through the turbine of a power supply in the downhole portion of such a system in order to maintain operation of the power supply within required limits of the system.

BACKGROUND OF THE INVENTION

In a measurement while drilling system the downhole equipment requires electrical power which is provided by a power supply that includes a motive power source to extract mechanical energy from kinetic energy of drilling fluid passing through the drill string, and an electrical power source in the form of a generator or an alternator coupled with the motive power source. In the operation of such a power supply it it important to regulate the speed of the generator or alternator to operate within its design limits so that the downhole electrical equipment will be provided with a relatively constant and adequate supply of electrical energy for proper operation. Regulating the operation of this power supply requires the consideration of several factors including electrical loading of the electrical power source due to operating demands of the associated electrical system; pressure and flow rate variations in the drilling fluid flow, and occluding, plugging or clogging of the motive power source with particulate matter that is carried in the drilling fluid.

The present invention concerns the flow of drilling fluid through the motive power source portion of this apparatus. Typically the motive power source includes a turbine with its blade or rotary element mounted on or operably connected to the rotatable shaft of an alternator. The turbine receives high pressure drilling fluid at its inlet and discharges the fluid at a lower pressure at its outlet. The turbine is designed so that motion of a valve member relative to the inlet will regulate the quantity of drilling fluid passing through the turbine in relation to the quantity of drilling fluid by-passing the turbine's inlet.

In prior constructions when the inlet to the turbine is stationary in relation to its location in the drilling fluid flow the turbine must accept a theoretically fixed proportion of the drilling fluid. This construction is undesirable due to fluctuations in the drilling fluid flow rate and pressure which also vary the fluid flow rate through the turbine and thereby vary its operating speed. This variation will directly effect the alternators performance. Also this arrangement does not account for clogging or plugging of the turbine by particulate material and the like that is carried through the drilling fluid. Because the power output from the alternator can obviously vary if the turbine is occluded or plugged and made inoperable, this prior construction is not desirable.

In another prior construction of this equipment a movable valve member can be provided which is spring urged to a position that directs substantially all of the drilling fluid to pass through the turbine and relaxed from this position only in response to the drilling fluid pressure acting in opposition to the spring. This arrangement while providing some degree of regulation for fluid flow through the turbine is not responsive to rapid changes of the differential across the turbine. Also, it is not responsive to short duration pressure pulses in the mud flow that tend to change the speed of the turbine. Through experimentation it has been found that the pressure differential across such a turbine is important to regulating the rotational speed thereof and that the two above described prior art constructions are inadequate to provide consistent regulation of the power supply.

SUMMARY OF THE INVENTION

An embodiment of a mud by-pass regulator apparatus for a measurement while drilling system includes a valve apparatus to direct drilling fluid or mud to the inlet of a turbine's blade or rotary element and to by-pass some of this fluid from the turbine's blade inlet. The valve apparatus is moved by a valve actuator apparatus in response to a actuator control apparatus that is responsive to the fluid pressure drop between inlet and the outlet portions of the turbine's blade. The valve apparatus has a valve member positioned at the inlet portion of the turbine and movable from a first position of minimum flow diversion from the turbine to a second position of maximum by-pass of the turbine. This movement of the valve apparatus is done in a variable relation. The valve actuator control apparatus senses the fluid pressure both ahead of and downstream of the turbine and in response to these parameters along with a spring it moves the valve member accordingly to operably regulate the valve actuator. Maintaining the pressure drop across the turbine within predetermined limits during normal operation of the measurement while drilling system is very desirable to provide a uniformly dependable power output from the alternator.

One object of this invention is to provide a mud by-pass regulator apparatus for a measurement while drilling system having a valve, a valve actuator and a valve actuator control that function cooperatively to regulate the flow of mud or drilling fluid passing through the inlet and by-passing a turbine in a downhole power supply wherein such apparatus overcomes the aforementioned disadvantages of the prior art devices.

Still, one other object of this invention is to provide a mud by-pass regulator apparatus that maintains the pressure drop across the turbine in such a power supply within a predetermined range of values so that power output from the power supply is maintained substantially constant for varying operating conditions.

Still, another object of this invention is to provide a mud by-pass regulator apparatus having a valve actuator and actuator control that is responsive to pressure and flow rate changes in high pressure drilling fluid passing through the drill string.

Various other objects, advantages and features of this invention will become apparent to those skilled in the art from the following discussion, taken in conjunction with the accompanying drawings, in which:

Figure 1:
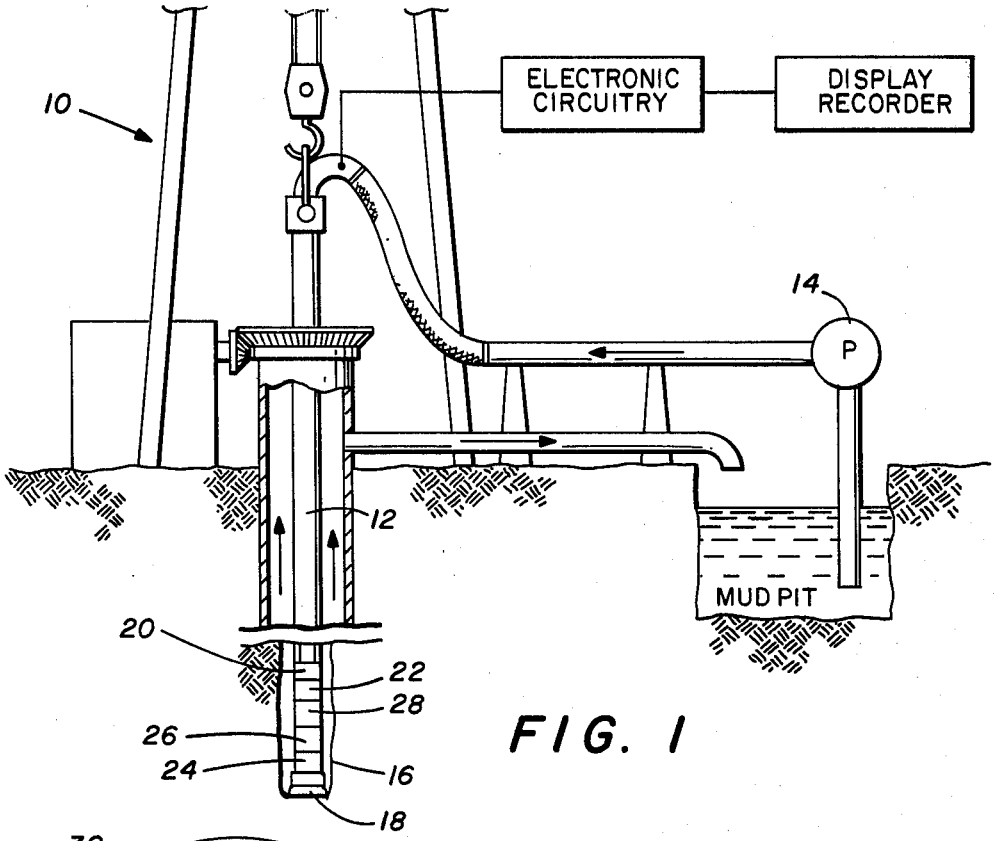
FIG. 1 is a pictorial representation of a measurement while drilling system employed in an earth borehole drilling rig of the type that is adapted for using the apparatus of this invention.
Figure 3:
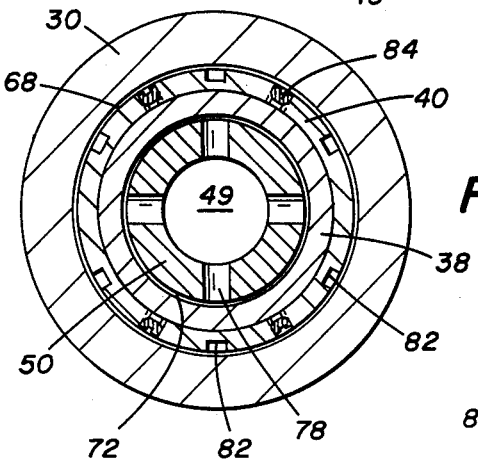
FIG. 3 is a cross sectional view of the apparatus shown in FIG. 2 with the cross section taken at the line 3—3 therethrough.

The following is a discussion and description of preferred specific embodiments of the mud by-pass regulator apparatus of this invention such being made with reference to the drawings whereupon the same reference numerals are used to indicate the same or similar parts and/or structure. It is to be understood that such discussion and description is not to unduly limit the scope of the invention.

DETAILED DESCRIPTION OF THE PREFERRED EMBODIMENT

Referring to FIG. 1 this illustrates a measurement while drilling system incorporated with an earth borehole drilling rig indicated generally at 10. The measurement while drilling system includes a downhole apparatus at the bottom portion of drill string 12 to sense various parameters and transmit such to the earth's surface through pressure pulses in the drilling fluid or mud flow. At the earth's surface the system has equipment including electronic circuitry and display for recovering this data and displaying it for observation and also for recording purposes. Drilling fluid or mud under pressure is moved by pump 14 through drill string 12 to the bottom of borehole 16 where it exits at drilling bit 18. In passing through the borehole portion of the measurement while drilling apparatus the mud flows through the by-pass regulator 20 and around a portion of power supply 22 where kinetic energy is extracted from the flowing fluid by a motive power source and transformed into electrical energy for use in operating other portions of the downhole apparatus. The downhole portion of this apparatus can include mechanical and geometric sensors 24, lithological sensors 26, and a transmitter 28 along with associated data preparation circuitry.

In operation of this downhole portion of the apparatus it can function cyclically to sample the data and transmit it to the earth's surface. Thus, demands for electrical power may vary depending upon the cyclic state of the electrical apparatus. However such electrical power demands may generally be below some determinable value and it is this value which forms a minimum power output requirement for the power supply. A requirement of the power supply of the apparatus described herein is to ideally be a constant output power supply so that electrical requirements of the system are met. Also in normal drilling operations the mud pressure can be varied depending upon the speed of pump 14 and other factors. The drilling mud pressure is normally varied depending upon the drilling conditions at the well and the desire of the drilling operators. Thus, it can vary from a minimum of about five hundred (500) pounds per square inch to a maximum in the neighborhood of twenth thousand (20,000) pounds per square inch at the earth's surface. This mud pressure will also vary in magnitude due to pulsations from the mud pump at the earth's surface and also because of the short duration pressure pulses used for data transmission from the downhole equipment to the earth's surface data receiving equipment.

Figure 2:
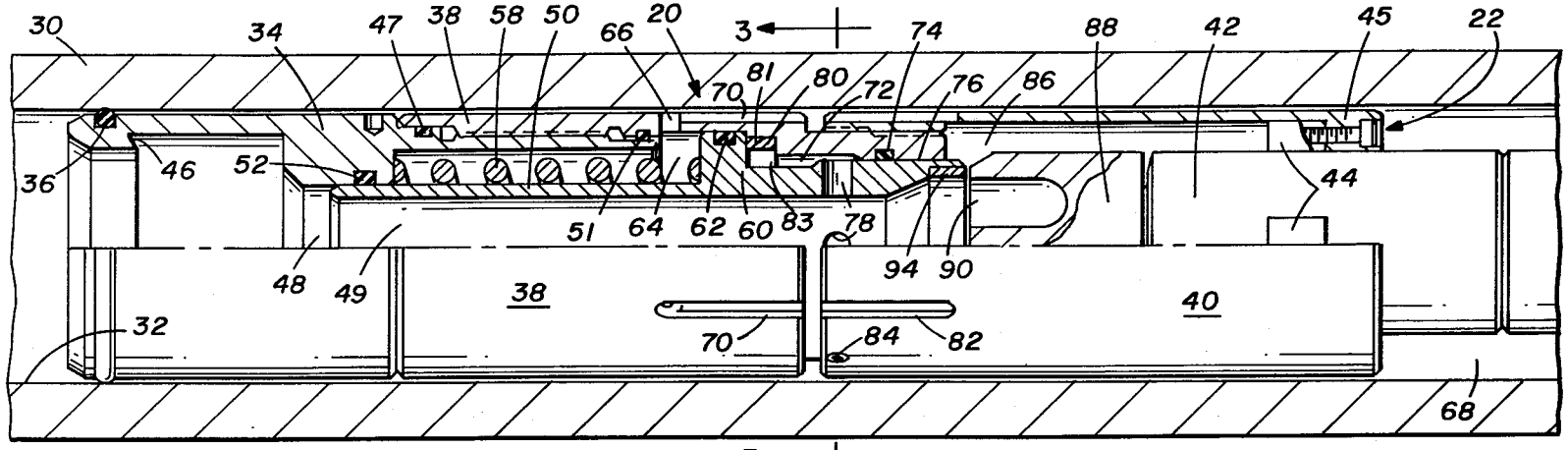
FIG. 2 is a cutaway and partially sectional elevation view of a portion of the downhole measurement while drilling apparatus showing the valve assembly in its first position with the valve member closest to the power supply turbine's blade.

Referring to FIG. 2 the by-pass regulator 20 is contained within a special collar 30 that is coupled into drill string 12 between the lower most joint of conventional drill pipe and drilling bit 18. The left hand portion of FIG. 2 is the upper end of the apparatus when it is positioned for operation in a well. Collar 30 receives the drilling fluid or mud through the interior thereof just as do the conventional joints of drill pipe. The interior of collar 30 is specifically adapted for mounting the measurement while drilling apparatus. Collar 30 has a cross sectionally circular interior surface 32 extending through the portion shown in FIG. 2.

By-pass regulator 20 is mounted at the upper end portion of this downhole apparatus as illustrated generally in FIG. 1 so that drilling fluid will pass through this portion of the apparatus prior to passing around other lower portions of the downhole equipment. A by-pass housing inlet sleeve 34 at the upper portion of by-pass regulator 20 receives the mud flow and forms the upper end portion of the device. A seal ring 36 mounted in a groove around the exterior of by-pass housing inlet sleeve 34 seals between by-pass housing inlet sleeve 34 and collar interior surface 32 thereby preventing mud flow around by-pass regulator 20. Below by-pass housing inlet sleeve 34 and mounted therewith is by-pass housing sleeve 38 that forms a mid-portion of the by-pass regulator. Threadedly attached to by-pass housing sleeve 38 and extending downwardly therefrom is alternator housing 40. Alternator housing 40 is mounted in a spaced relation around the exterior of alternator 42.

Alternator housing 40 is secured to alternator 42 by a plurality of mounting blocks 44 on alternator 42. These mounting blocks 44 are secured in a spaced relation around the exterior of alternator 42. The lower end portion of alternator housing 40 is provided with a plurality of alternately spaced passageways and mounting lugs 45 aligning mounting blocks 44 and lugs 45 positions the passageways so that the drilling fluid or mud can flow from the turbine through the interior of alternator housing 40 into the annular space between alternator 42 and collar interior surface 32 when exiting the by-pass regulator.

At the upper portion of by-pass regulator 20 housing inlet sleeve 34 a recess 46 is formed around the interior thereof for use in removal of the sleeve from collar 30. By-pass housing inlet sleeve 34 has a reduced diameter interior passageway 48 through a mid-portion thereof which serves as the fluid passageway and as a support for the upper end portion of by-pass sleeve 50. A seal ring 52 is mounted in a circular groove around the interior passageway 48 of by-pass housing inlet sleeve 34 to seal against an exterior portion of by-pass sleeve 50. The exterior of the lower portion of by-pass housing inlet sleeve 34 is threaded to receive the interior of by-pass housing sleeve 38 therearound. Seal rings 47 and 51 are respectively mounted in grooves in sleeves 34 and 38 to provide a fluid seal between these members. The lower portion of the interior of by-pass housing inlet sleeve 34 has a recess to support and contain spring 58 that extends between a downwardly facing abutment on by-pass housing inlet sleeve 34 and an upwardly facing abutment on by-pass sleeve 50. By-pass sleeve 50 has an interior passageway 49 therethrough to pass drilling mud to a turbine that is described hereinafter.

By-pass sleeve 50 divides by-pass regulator 20 into a high pressure portion and a low pressure portion at an outwardly extending radial enlargement 60. This radial enlargement 60 will be referred to hereinafter as a piston portion of the by-pass sleeve. Piston portion 60 is provided with a seal ring 62 therearound to seal on an interior surface of by-pass housing sleeve 38. A low pressure fluid chamber 64 is formed between by-pass housing inlet sleeve 34, by-pass sleeve 50, and by-pass housing sleeve 38. Low pressure fluid chamber 64 is in fluid communication with collar interior annulus by low pressure port 66. Collar interior annulus 68 is the annular opening or space around the equipment contained in special collar 30. During operation the fluid pressure in this annulus is lower than the mud pressure above by-pass regulator 20 and it is greater then the borehole annulus fluid pressure. Low pressure port 66 joins a longitudinally oriented slot 70 extending from port 66 to the lower end of the larger diameter segment of by-pass housing sleeve 38. A plurality of such ports and slots like port 66 and slot 70 are provided in spaced relation around the periphery of by-pass housing sleeve 38. This low pressure fluid connection enables fluid at a low pressure to act on the upper portion of piston 60 in conjunction with spring 58 to urge by-pass sleeve 50 in the downward direction or toward the first position of the valve.

Figure 4:
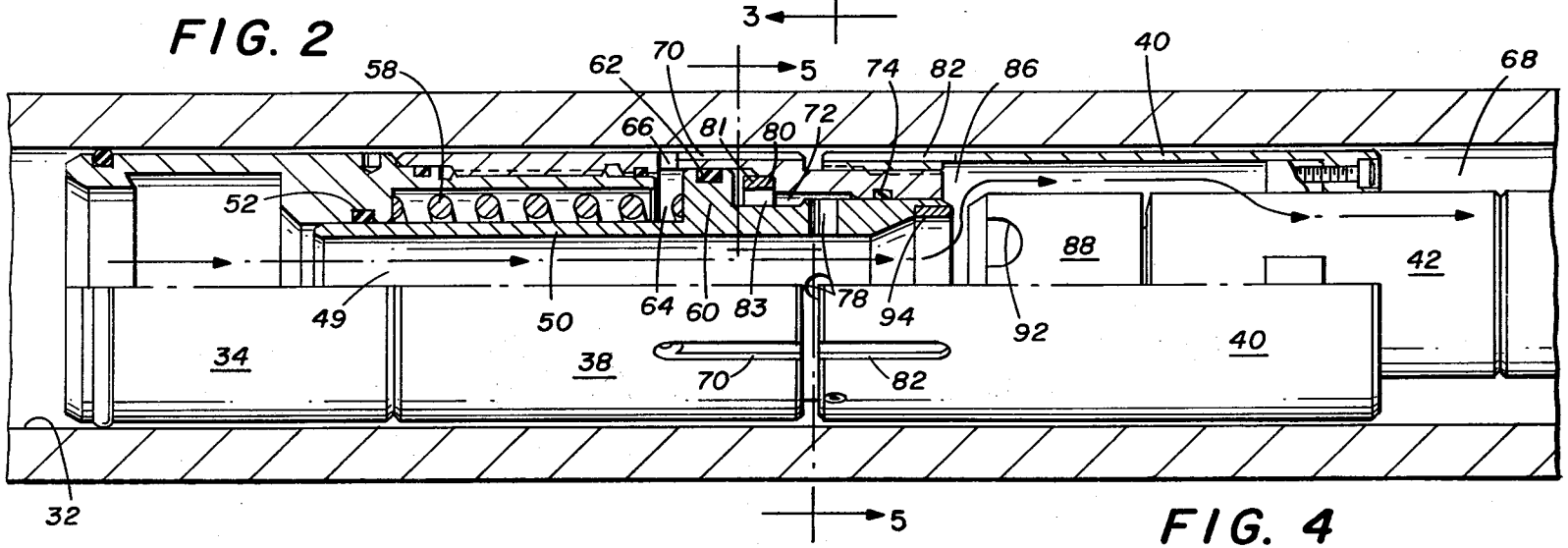
FIG. 4 is a view similar to FIG. 2 with the valve member and actuator displaced substantially away from the turbine's blade toward the second position.

Below by-pass sleeve piston portion 60 a high pressure chamber 72 is formed between the exterior of by-pass sleeve 50 and an interior portion of by-pass housing sleeve 38. High pressure chamber 72 extends between seal ring 62 around piston portion 60 to another seal ring 74 mounted in a groove in the interior of the lower portion of by-pass housing sleeve 38 and contacting an exterior seal surface 76 on by-pass sleeve 50. A high pressure port 78 through by-pass sleeve 50 communicates high pressure drilling fluid or mud from the interior of by-pass sleeve 50 to high pressure chamber 72 in order to apply this type fluid pressure to the lower side of piston portion 60. A spacer ring 80 is positioned adjacent to the lower side of piston portion 60 and contactable with an upwardly facing abutment around the interior of by-pass housing sleeve 38. Spacer ring 80 provides a physical separation between piston portion 60 and a facing portion of by-pass housing sleeve 38 in order to prevent the accumulation of foreign material between these portions of the respective parts. Spacer ring 80 fits snugly into by-pass housing sleeve 38 where it is retained in by-pass housing sleeve 38. Spacer ring 80 has a plurality of spaced apart lugs 81 thereon that will contact the downwardly facing side of piston portion 60 when in the position shown in FIG. 2. Spacer ring 80 can remain in place in by-pass housing sleeve 38 as by-pass sleeve 50 moves upward as is illustrated in FIG. 4. The interior of spacer ring 80 has its interior diameter surface 83 substantially separated from the exterior of by-pass housing sleeve 38. The opening between spacer ring 80 and by-pass housing sleeve 38 combined with the space between lugs 81 permits fluid pressure in high pressure fluid chamber 72 to act over the entire downwardly facing side of piston portion 60 when it is positioned as shown in FIG. 2.

Alternator housing 40 is a cylindrical member that on its upper end portion is threadedly mounted with the exterior of the lower portion of by-pass housing sleeve 38. The upper end of alternator housing 40 is spaced from the lower end of the largest diameter portion of by-pass housing sleeve 38. A plurality of longitudinal slots are provided in alternator housing 40 from its upper end portion to a mid-portion thereof below its threaded mounting with by-pass housing sleeve 38. Slots 82 provide for low pressure fluid communication between the annular space 86 within alternator housing 40 around turbine's blade 88 and other low pressure fluid in collar interior annulus 68. Annular space 86 is in fluid communication with collar interior and annulus 68 through slots 82 and through openings in alternator housing 40 between mounting blocks 44.

Figure 5:
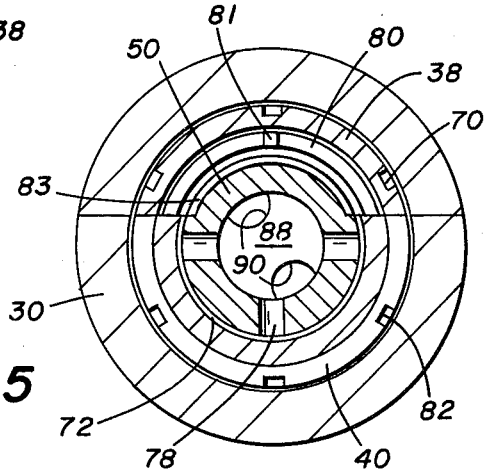
FIG. 5 is a cross sectional view of the apparatus shown in FIG. 4 with the view taken on line 5—5 therethrough.

The turbine has its rotary element or blade 88 mounted on the rotatable shaft of alternator 42. Turbine blade 88 is of the reaction type design which reacts to the exit velocity of drilling fluid. Turbine blade 88 is provided with an upwardly facing inlet having a pair of openings 90 to receive mud or drilling fluid through the interior of by-pass sleeve 50 as can be seen in FIGS. 2 and 5. Turbine blade 88 has outlet "D" shaped openings 92 on its peripheral exterior as shown in FIG. 4. Outlets 92 discharge the mud into annular space 86 in alternator housing 40.

At the lower end of by-pass sleeve 50 is the valve assembly that has a ring like resilient valve element 94 mounted therearound. Valve element 94 has a diameter sized corresponding to that of the upwardly facing portion of turbine blade 88. The facing end surfaces of valve element 94 and turbine blade's inlet side are spaced apart a small distance as shown in FIG. 2 when the valve is in its first or most restrictive position so that fluid flow into and through turbine blade inlet 90 is maximized and fluid flow around turbine blade 88 between its inlets and the outlets is minimized. When by-pass sleeve 50 is moved to its second position which is that having valve element 94 farthest spaced from turbine blade inlet 90 then fluid flow into and through turbine blade inlet 90 is minimized and the fluid bypassing turbine blade 88 is at a maximum.

In operation of the by-pass regulator 20 of this invention it will initially have the valve essentially closed or in the first position as shown in FIG. 2 before the mud is pumped through the tubing string. Drilling mud flows through the interior of tubine string 12 including the interior of collar 30 and the interior of by-pass sleeve 50, through turbine blade 88 and into collar interior annulus 68 whereupon it flows in a continued downward direction around other portions of the measurement while drilling apparatus and exits at drill bit 18 into the borehole annulus. This drilling fluid is pumped downward at a pressure that can be as high as about 5000 psi when measured at the earth's surface which will be a greater pressure at the by-pass regulator 20 depending upon the depth of the well and the weight of the drilling fluid involved. The flow rate of drilling mud through the drill string of an operating drill rig will vary depending upon the pump capacity of the rig, depth of the well and physical properties of the drilling mud just to mention a few variables. This flow rate can be maintained within certain limits in order to provide a typical or average drilling mud flow rate. In wells of depths between about 2,500 feet to about 20,000 feet it is possible to maintain the drilling mud flow rate between about 300 to 1200 gallons per minute with an average flow rate of about 700 gallons per minute. With by-pass regulator 20 in the position shown in FIG. 2 the maximum amount of mud is directed into turbine blade inlet openings 90 so that turbine blade 88 will receive the maximum amount of fluid. This operating condition will permit the turbine to receive the maximum amount of fluid. This operating condition will permit the turbine to extract a maximum amount of kinetic energy from the flowing drilling fluid.

The spacing between valve element 94 and turbine blade 88 can be adjusted by the threaded connection between alternator housing 40 and by-pass housing sleeve 38. When a desired spacing dimension is achieved these two housings are secured in a fixed rotational position by set screws 84. Adjustment of this spacing dimension functions to adjust the minimum fluid by-pass flow rate of by-pass regulator 20. It also has an effect on the average flow rate setting and the maximum flow rate by-pass operation. Adjustment of this factor presets by-pass regulator 20 for a range of drilling mud flow rates that are to be expected prior to using the equipment. This adjustment can be done from the exterior of this apparatus prior to placing it inside collar 30 by loosening set screws 84 and rotating the separate portions of the housing in order to set the spacing for a particular average flow rate to be encountered on a specific drilling rig.

By-pass regulator 20 is designed to maintain a predetermined pressure drop between mud passageway 49 in by-pass sleeve 50 and annular space 86 surrounding the outlet portion of turbine blade 88. The pressure drop between these two areas is intended to be kept with the range of about 50 psi to about 500 psi in a broad selection. Also this pressure range can be kept between 150 to 200 psi in a narrow selection of this range. The by-pass regulator is also designed to react quickly to changes that effect the pressure drop across turbine blade 88 so that small and short duration pulsations in the mud pressure will be compensated for by this apparatus. In an overall perspective these features of by-pass regulator 20 function to operate the turbine at a substantially constant energy output condition so that the associated electrical power supply of the measurement while drilling apparatus also has a substantially constant power output.

As fluid pressure and flow rate increase through the drill string from a non-operating condition this raises fluid pressure within passageway 49 of by-pass sleeve 50 so that the fluid pressure in high pressure chamber 72 is greater than the fluid pressure in low pressure fluid chamber 64. This will cause by-pass sleeve 50 to function as a valve actuator and displace valve member 94 from the first position shown in FIG. 2 once the pressure differential between chambers 72 and 64 become sufficient to overcome the force of spring 58. Spring 58 biases by-pass sleeve 50 (which is the valve actuator) toward the first position as shown in FIG. 2. When the drilling mud pressure within mud passageway 49 becomes sufficiently high relative to the low pressure drilling fluid in annular space 86 this will provide sufficient force to displace the valve actuator and the attached valve member to a position similar to that shown in FIG. 4 wherein the spacing between valve element 94 and the turbine blade inlet portion is increased from that shown in FIG. 2. It is the change in pressure differential between the interior of mud passageway 49 and annular space 86 that displaces valve member 94 from the position of FIG. 2 toward that of FIG. 4. This changing differential pressure in conjunction with the fluid under pressure in chambers 72 and 64 operatively function as a valve actuator control to regulate the position of the valve actuator which in turn controls the position of valve element 94.

When fluid pressure increases in collar interior annulus 68 from some previous pressure level this increases the pressure in annular space 86 around the turbine blade and subsequently decreases the pressure differential between mud and passageway 49 and annular space 86 or across the turbine. The decrease in pressure drop across the turbine will naturally slightly decrease its rotational speed. This also increases the fluid pressure in chamber 64 relative to the pressure in chamber 72. As a result of this relationship valve actuator control is established to move the valve actuator including valve member 94 toward turbine blade 88. When this occurs the amount of fluid available at the inlets of turbine blade 88 is increased from its previous operating condition and as a result it can be expected that the rotational speed of the turbine may also be slightly increased in order that the amount of energy extracted from the mud flow by the turbine will remain appreciably constant as desired.

In the opposite sense when fluid pressure in collar interior annulus 68 decreases it will cause an increase in the pressure differential between mud passageway 49 and annular space 86. This fluid pressure change in collar interior annulus 68 will decrease the pressure in chamber 64 relative to the pressure in chamber 72 and present an increased pressure drop across the turbine. As a result, the fluid pressure in chamber 72 will have a greater effect on the valve actuator and cause the valve actuator to move bypass sleeve 50 and valve member 94 away from turbine blade 88 and increase the mud flow bypassing turbine blade 88. As a result of this the turbine will be extracting proportionally less kinetic energy from the mud flow.

In use and operation of the by-pass regulator of this invention it has been found that even minute changes in the pressure differential across turbine can cause the valve actuator control to displace the valve member by means of the valve actuator in an extremely rapid response to the changing pressure conditions. In this operation it has also been found that when utilizing this by-pass regulator in a mud pulse pressure data transmission system of a measurement while drilling apparatus that pressure pulses emanating from the data transmitter in the system will affect the pressure drop across the turbine and that the apparatus of this invention will function to maintain the turbine performance and the power supply performance within a predetermined operating range in order to provide a substantially constant output power supply for operating the associated electrical equipment.

In reducing this by-pass regulator apparatus to practice it is observed that several modifications thereof can be made without departing from the scope of the invention. For example, spring 58 is illustrated as a helical spring however it is to be understood that the spring can be provided in another configuration such as a mechanical spring of a different configuration, or an elastomeric spring, or a combination of elastomeric and mechanical springs or a fluid spring. The valve member is shown as a ring-like member however it can be reconfigured to other physical arrangements depending upon the particular turbine blade construction. Additionally, by-pass sleeve 50 is shown as an elongated member having a piston portion 60 extending radially outward around a mid-portion thereof however it is to be understood that this can be physically reconfigured to conform with other physical constraints of a particular measurement while drilling apparatus.

Although specific preferred embodiments of the present invention have been described in detail the above description is not intended to limit the invention to a particular form or embodiment disclosed herein since they are to be recognized as illustrative rather than restrictive and it would be obvious to those skilled in the art that the invention is not so limited. Thus, the invention is declared to cover all changes and modifications of the specific example of the invention herein disclosed for the purpose of illustration which does not constitute departures from the spirit and the scope of the invention.

The embodiments of the invention in which an exclusive property or privilege is claimed or defined as follows:

1. In a measurement while drilling system for a drilling rig having a sensor in a drill string to sense at least one of geophysical borehole and mechanical drill string parameters, a power source in the drill string using drilling fluid motion through the drill string to power a motive power source and to in turn power an electrical power source, a transmitter in the drill string to transmit sensed data to the earth's surface, a receiver at the earth's surface to receive the transmitted data and a data display means at the earth's surface, an improvement in the system, comprising:

(a) valve means in the drill string operably mounted upstream of the motive power source and operable to control fluid flow past said motive power source;

(b) valve actuator means with said valve means to displace said valve means in variable relation between first and second positions; and (c) valve actuator control means including means responsive to said valve actuator means in order to maintain a fluid pressure differential across said motive power source within a predetermined range.

2. The improvement of claim 1, wherein:

(a) said valve actuator control means has a plurality of fluid pressure sensing portions operable to sense operating differential pressures of said valve means; and (b) said valve actuator means has an area exposed to relatively high fluid pressure from the drilling fluid, and another area on an opposing portion thereof exposed to relatively low fluid pressure from the drilling fluid, and a spring contacting said valve member urging it towards said first position.

3. The improvement of claim 2, wherein:

(a) said system has a housing containing said valve means, said valve actuator means, said motive power source, and said electrical power source;

(b) said motive power source has a turbine blade rotatively mounted to receive drilling fluid flowing through said drill string; and (c) said valve means has a sleeve longitudinally, slidably mounted in said housing with an end portion positioned adjacent to said turbine blade in a first position to substantially increase fluid flow into said turbine blade, and said sleeve being longitudinally movable toward a second position with said end portion being displaced from said turbine blade to decrease drilling fluid into said turbine blade.

4. The improvement of claim 3, wherein:

(a) said housing has an interior chamber containing said valve means;

(b) said motive power means and said electrical power means are contained within said housing below said valve means;

(c) said valve actuator means has a plurality of seals around the exterior portions thereof residing in sealing contact with an interior surface of said housing thereby forming a high pressure fluid chamber and a low pressure fluid chamber, said high pressure fluid chamber being in fluid communication with said drilling fluid in said drill string at a location upstream of said turbine blade, and said low pressure fluid chamber being in fluid communication by an aperture through said housing with a relatively low pressure drilling fluid present around the exterior of said housing within said drill string; and (d) said low pressure fluid chamber has opposed internal abutments with a spring mounted therebetween to urge said valve member toward said first position, said valve member being urged toward said first position by said spring and low fluid pressure acting in said low pressure fluid fluid chamber in opposition to force due to high pressure fluid in said high pressure fluid chamber, said valve actuator means being adapted in operation to maintain a pressure differential across said turbine blade within a predetermined range of values.

5. The improvement of claim 4, wherein:

(a) the range of values of pressure differential across said turbine blade is between about 50 pounds per square inch to about 500 pounds per square inch;

(b) said valve means is moved toward said turbine blade by said spring alone when drilling fluid pressure is equalized between inner and outer portions of said housing including said low and said high pressure fluid chambers, when drilling fluid pressure in said drill string is increased during operation of said system, said pressure drop increases the fluid pressure in said high pressure fluid chamber which displaces said valve member from said first position toward said second position in opposition to said spring and the force of said low pressure fluid acting on said valve actuator means in said low pressure fluid chamber in order to increase the quantity of drilling fluid bypassing said turbine blade and when drilling fluid pressure in said drill string is decreased during operation of said system such decreases the fluid pressure in said high pressure fluid chamber which displaces said valve member toward said first position in order to decrease the quantity of drilling fluid bypassing said turbine blade and increasing the quantity of drilling fluid directed into said turbine blade.

6. The improvement of claim 4, wherein the range of values of pressure differential across said turbine blade is between about 150 pounds per square inch to about 200 pounds per square inch.

7. The improvement of claim 1, wherein the fluid pressure differential across said motive power source is within the range of about 150 pounds per square inch to about 200 pounds per square inch.

8. The improvement of claim 1, wherein said valve actuator control means has means to adjust the relative position of said valve means to correspondingly preset the proportional drilling fluid flow rate past motive power source.

9. A measurement while drilling system for a drilling rig having:

(a) a sensor in a drill string to sense at least one of geophysical borehole and mechanical drill string parameters;

(b) a power source in the drill string using drilling fluid motion through the drill string to power a motive power source and to in turn power an electrical power source;

(c) a transmitter in the drill string to transmit sensed data to the earth's surface;

(d) a receiver at the earth's surface to receive the transmitted data and a data display means at the earth's surface;

(e) valve means in the drill string operably mounted upstream of the motive power source and operable to control fluid flow past said motive power source and said valve means being separate from said transmitter;

(f) valve actuator means with said valve means to displace said valve means in variable relation between first and second positions; and (g) valve actuator control means including means responsive to said valve actuator means operable in order to maintain a fluid pressure differential across said motive power source within a predetermined range.

10. The system of claim 9, wherein:

(a) said valve actuator control means has a plurality of fluid pressure sensing portions operable to sense operating differential pressures of said valve means; and (b) said valve actuator means has an area exposed to relatively high fluid pressure from the drilling fluid, and another area on an opposing portion thereof exposed to relatively low fluid pressure from the drilling fluid, and a spring contacting said valve member urging it towards said first position.

11. The system of claim 10, wherein:

(a) said system has a housing containing said valve means, said valve actuator means, said motive power source, and said electrical power source;

(b) said motive power source has a turbine blade rotatively mounted to receive drilling fluid flowing through said drill string; and (c) said valve means has a sleeve longitudinally, slidably mounted in said housing with an end portion positioned adjacent to said turbine blade in a first position to substantially increase fluid flow into said turbine blade and said sleeve being longitudinally movable therefrom toward a second position displaced from said turbine blade to decrease drilling fluid flow into said turbine blade.

12. The system of claim 11, wherein:

(a) said housing has an interior chamber containing said valve means;

(b) said motive power means and said electrical power means are contained within said housing below said valve means;

(c) said valve actuator means has a plurality of seals around the exterior portions thereof residing in sealing contact with an interior surface of said housing thereby forming a high pressure fluid chamber and a low pressure fluid chamber, said high pressure fluid chamber being in fluid communication with said drilling fluid in said drill string at a location upstream of said turbine blade, and said low pressure fluid chamber being in fluid communication by an aperture through said housing with a relatively low pressure drilling fluid present around the exterior of said housing within said drill string; and (d) said low pressure fluid chamber has opposed internal abutments with a spring mounted therebetween to urge said valve member toward said first position, said valve member being urged toward said first position by said spring and low fluid pressure acting in said low pressure fluid chamber in opposition to force due to high pressure fluid in said high pressure fluid chamber, said valve actuator means being adapted in operation to maintain a pressure differential across said turbine blade within a predetermined range of values.

13. The system of claim 12, wherein:

(a) the range of values of pressure differential across said turbine blade is between about 50 pounds per square inch to about 500 pounds per square inch;

(b) said valve means is moved toward said turbine blade by said spring alone when drilling fluid pressure is equalized between inner and outer portions of said housing including said low and said high pressure fluid chambers, when drilling fluid pressure in said drill string is increased during operation of said system, said pressure drop increases the fluid pressure in said high pressure fluid chamber which displaces said valve member from said first position toward said second position in opposition to said spring and the force of said low pressure fluid acting on said valve actuator means in said low pressure fluid chamber in order to increase the quantity of drilling fluid bypassing said turbine blade and when drilling fluid pressure in said drill string is decreased during operation of said system such decreases the fluid pressure in said high pressure fluid chamber which displaces said valve member toward said first position in order to decrease the quantity of drilling fluid bypassing said turbine blade and increasing the quantity of drilling fluid directed into said turbine blade.

14. A drilling fluid bypass means for measurement while drilling system for a drilling rig having a power source in a drill string using drilling fluid motion through the drill string to power a motive power source and to in turn power an electrical power source wherein the drilling fluid bypass means comprises:

(a) valve means in a drill string operably mounted upstream of a motive power source in a measurement while drilling apparatus and operable to control fluid flow past said motive power source;

(b) valve actuator means with said valve means to displace said valve means in variable relation between first and second positions; and (c) valve actuator control means including means responsive to said valve actuator means in order to maintain a fluid pressure differential across said motive power source within a predetermined range in order to maintain the operable power output of said electrical power source substantially constant.

15. The drilling fluid bypass means of claim 14, wherein:

(a) said drilling fluid bypass means has a housing containing said valve means, said valve actuator means, said motive power source, and said electrical power source;

(b) said motive power source has a turbine blade rotatively mounted to receive drilling fluid flowing through a drill string; and (c) said valve means has a sleeve longitudinally, slidably mounted in said housing with an end portion positioned adjacent to said turbine blade in a first position to substantially increase fluid flow into said turbine blade and said sleeve being longitudinally movable from the first position toward a second position displaced from said turbine blade to decrease drilling fluid flow passing into said turbine blade.

16. The drilling fluid bypass means of claim 14, wherein:

(a) said valve actuator control means has a plurality of fluid pressure sensing portions operable to sense operating differential pressures of said valve means; and (b) said valve actuator means has an area exposed to relatively high fluid pressure from the drilling fluid, and another area on an opposing portion thereof exposed to relatively low fluid pressure from the drilling fluid, and a spring contacting said valve member urging it towards said first position.

17. The drilling fluid bypass means of claim 15, wherein:

(a) said housing has an interior chamber in fluid communication with a drilling fluid passageway in a drill string containing said valve means;

(b) said motive power means and said electrical power means are contained within said housing below said valve means;

(c) said valve actuator means has a plurality of seals around the exterior portions thereof residing in sealing contact with an interior surface of said housing thereby forming a high pressure fluid chamber and a low pressure fluid chamber, said high pressure fluid chamber being in fluid communication with said drilling fluid in said drill string at a location upstream of said turbine blade, and said low pressure fluid chamber being in fluid communication by an aperture through said housing with a relatively low pressure drilling fluid present around the exterior of said housing within said drill string;

(d) said low pressure fluid chamber has opposed internal abutments with a spring mounted in compression therebetween to urge said valve member toward said first position, said valve member being urged toward said first position by said spring and low fluid pressure acting in said low pressure fluid chamber in opposition to force due to high pressure fluid in said high pressure fluid chamber, said valve actuator means being adapted in operation to maintain a pressure differential across said turbine blade within a predetermined range of values of from about fifty (50) pounds per square inch to about five hundred (500) pounds per square inch; and (e) said valve means being moved toward said turbine blade by said spring alone when drilling fluid pressure is equalized between inner and outer portions of said housing including said low and said high pressure fluid chambers, when drilling fluid pressure in said drill string is increased during operation of said system, said pressure drop increases the fluid pressure in said high pressure fluid chamber which displaces said valve member from said first position toward said second position in opposition to said spring and the force of said low pressure fluid acting on said valve actuator means in said low pressure fluid chamber in order to increase the quantity of drilling fluid bypassing said turbine blade and when drilling fluid pressure in said drill string is decreased during operation of said system such decreases the fluid pressure in said high pressure fluid chamber which displaces said valve member toward said first position in order to decrease the quantity of drilling fluid bypassing said turbine blade and increasing the quantity of drilling fluid directed into said turbine blade thereby terminating the operable power output of said electrical power source substantially constant.

18. The drilling fluid by-pass means of claim 14, where:

(a) said valve actuator control means has means to adjust the relative position of said valve means to preset the proportional flow rate of drilling fluid bypassing said motive power source; and (b) said means to adjust is manually adjustable from the exterior of said valve means, said valve actuator means and said valve actuator control means.

* * * * *